US005848717A

United States Patent [19]

Bösl et al.

[11] Patent Number: 5,848,717

[45] Date of Patent: Dec. 15, 1998

[54] SNAP-ON SEAL ARRANGEMENT ON A CONTAINER

[75] Inventors: Udo Bösl, Eimeldingen; Michael Kirchgessner, Egringen, both of Germany

[73] Assignee: Crown Cork AG, Reinach, Switzerland

[21] Appl. No.: 750,687

[22] PCT Filed: Apr. 17, 1996

[86] PCT No.: PCT/CH96/00140

§ 371 Date: Mar. 25, 1997

§ 102(e) Date: Mar. 25, 1997

[87] PCT Pub. No.: WO96/34807

PCT Pub. Date: Nov. 7, 1996

[30] Foreign Application Priority Data

May 1, 1995 [CH] Switzerland ..... 1236/95

[51] Int. Cl.[6] ..... B65D 41/16

[52] U.S. Cl. ..... 215/321; 215/317; 215/318

[58] Field of Search ..... 215/317, 318, 215/321; 220/780, 795

[56] References Cited

U.S. PATENT DOCUMENTS

| | | | |
|---|---|---|---|
| 2,445,647 | 7/1948 | Thomas | 215/317 X |
| 2,585,624 | 2/1952 | Bromley . | |
| 3,061,132 | 10/1962 | Geddes | 215/318 X |
| 3,494,497 | 2/1970 | Vercillo | 215/318 |
| 4,917,269 | 4/1990 | Fuchs et al. . | |
| 5,368,178 | 11/1994 | Towns et al. | 215/317 |
| 5,685,443 | 11/1997 | Taber et al. | 215/318 X |

*Primary Examiner*—Stephen K. Cronin

*Attorney, Agent, or Firm*—Woodcock Washburn Kurtz Mackiewicz & Norris LLP

[57] ABSTRACT

A snap-on seal arrangement comprising a container and a sealing cap is provided. The sealing cap comprises an elastically expandable cylindrical wall and at least one elastically deformable retaining bead for attachment to a container mouth having an external bead. An engagement surface of the retaining bead can be brought into effective engagement with an engagement surface of the external bead, wherein after the cap has been placed on, the engagement surface of the retaining bead of the sealing cap works together with the engagement surface of the external bead on the container mouth to enclose a radially outward-expanding gap. The retaining bead is elastically deformable such that the gap decreases in size or closes under the action of positive pressure in the container.

4 Claims, 3 Drawing Sheets

SNAP-ON SEAL ARRANGEMENT ON A CONTAINER

The invention pertains to a snap-on seal arrangement on a container, with a sealing cap with at least one retaining bead for attachment to a container mouth with an external bead, the retaining bead being provided on an elastically expandable cylindrical wall of the sealing cap, where an engagement surface of the retaining bead can be brought into effective engagement with an engagement surface of the external bead.

Snap-on seal arrangements of this type are known. They are made of an elastic grade of plastic material. In most cases, they consist of polyethylene or polypropylene and are produced in one piece by injection molding or compression molding. When the sealing cap is to be removed from the container mouth, the elastic expandability of the cylindrical wall on which the retaining bead is provided means that the retaining bead can be forced up, out, and over the external bead on the container mouth. It is also possible, however, for the sealing cap to be lifted unintentionally from the container mouth by the positive pressure prevailing inside the container.

The task of the invention consists in designing the snap-on cap arrangement described above in such a way that, in comparison with the known snap-on cap arrangements, greater safety is provided against the unintentional lifting-off of the sealing cap by the positive pressure prevailing in the container.

The task is accomplished by the snap-on cap arrangement according to the invention in that the engagement surface of the retaining bead on the sealing cap attached to the container mouth works together with the engagement surface on the external bead of the container mouth to enclose an outwardly expanding gap.

The outward-expanding gap between the two engagement surfaces has the effect that, as a result of a given positive pressure in the container, the forces acting to expand the cylindrical wall of the sealing cap are smaller than in comparable, known snap-on cap arrangements.

Exemplary embodiments of the invention are explained in greater detail below on the basis of the drawings.

Figure 3:
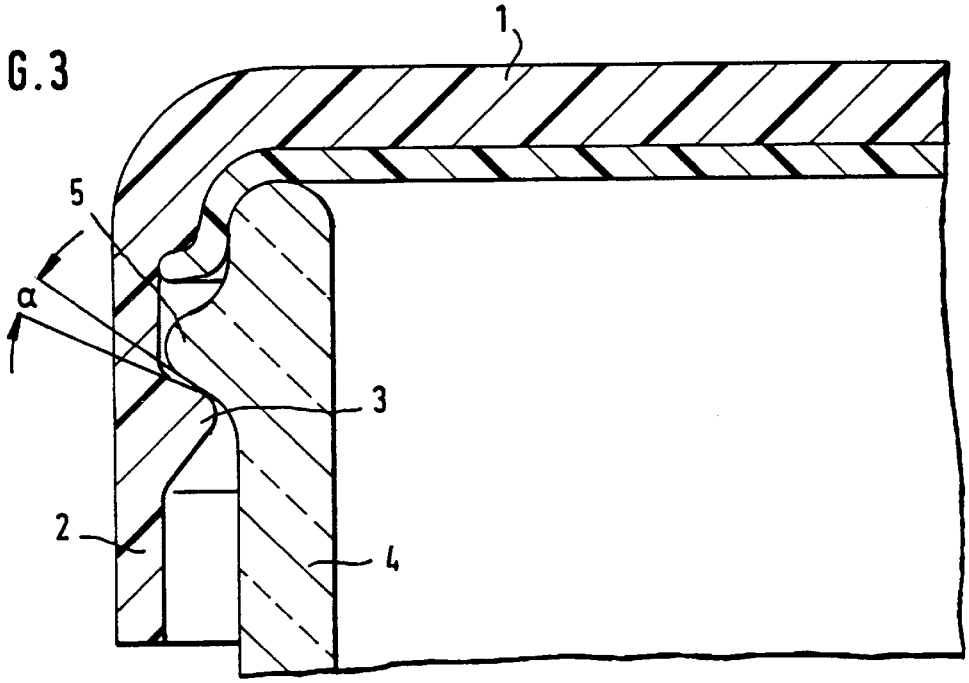
FIG. 3 shows on an enlarged scale a cross section through half of a sealing cap and the mouth of the container on which the sealing cap is seated.
Figure 4A:
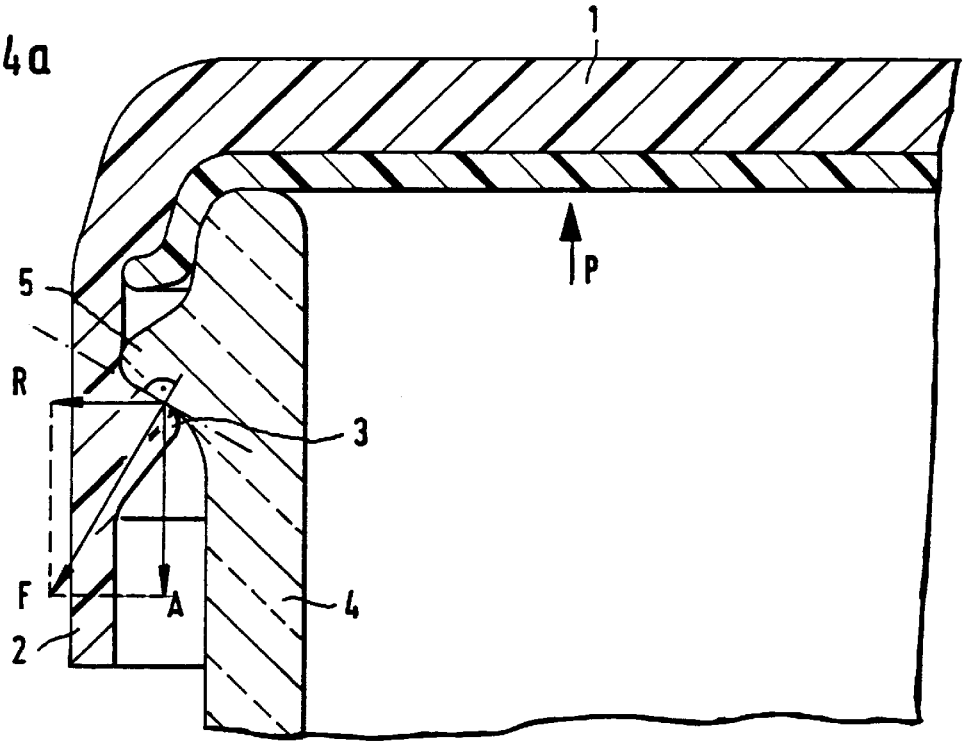
Figure 4B:
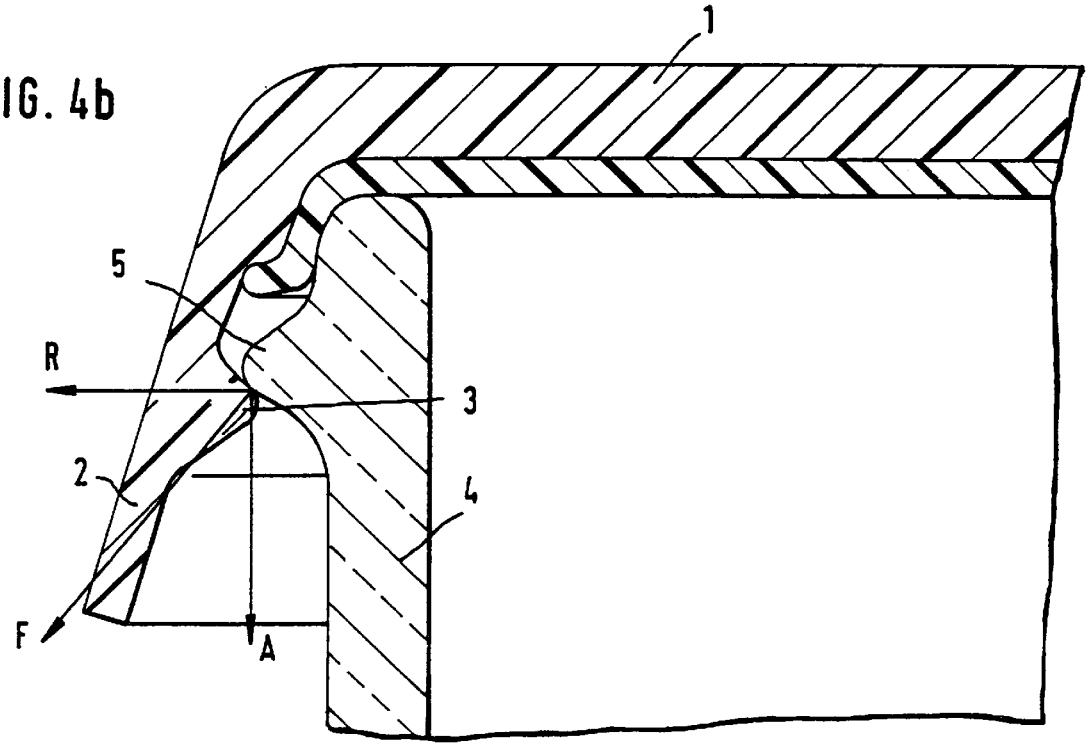
Figure 5:
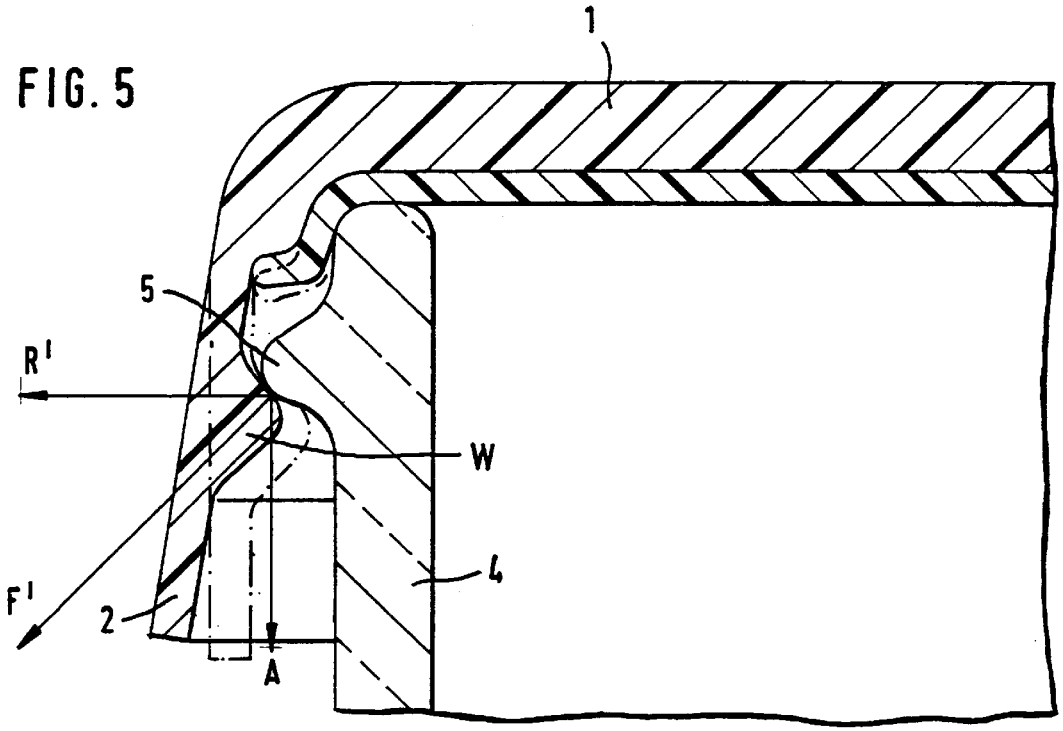

FIGS. 4*a* and 4*b*, in the same cross section as that of FIG. 3, show a state in which the sealing cap is deformed by the positive pressure prevailing in the container; and FIG. 5 shows, in the same cross section as that of FIG. 4, a sealing cap not according to the invention.

Figure 1:
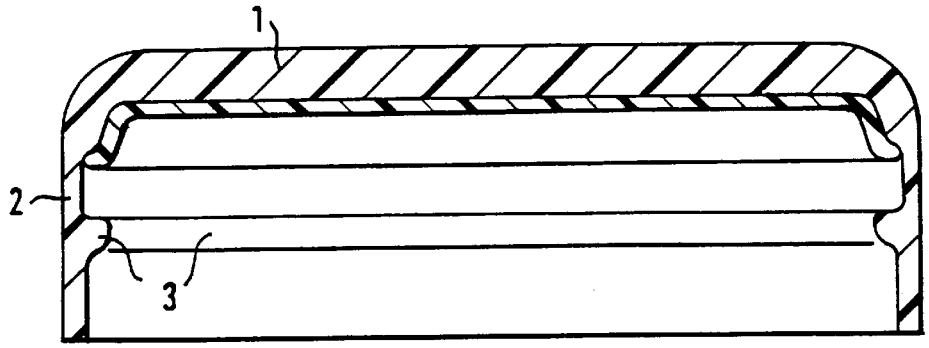
FIG. 1 shows a vertical cross section through a first sealing cap.

The sealing cap shown in FIG. 1 consists of plastic and has a circular top wall 1 and a cylindrical circumferential wall 2. A retaining bead 3, which extends around in the circumferential direction, is formed on the inside surface of circumferential wall 2. Circumferential wall 2 is able to expand outward in an elastic manner in such a way that, when the sealing cap is set onto the mouth of a container, retaining bead 3 can slide over an external bead on the container mouth and then lock itself behind this external bead. In the same way, retaining bead 3 is able to slide back over the external bead on the container mouth when the sealing cap is being removed from the container again.

Figure 2:
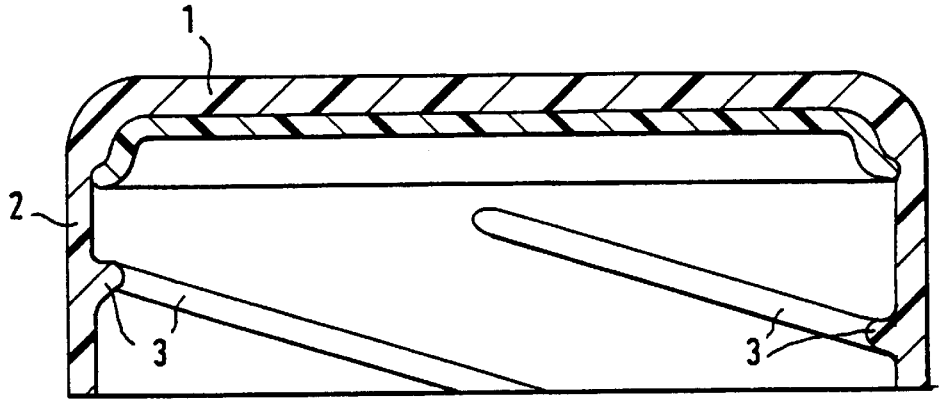
FIG. 2 shows a vertical cross section through a second sealing cap, which is designed as a threaded, snap-on sealing cap.

In the same way as that shown in FIG. 1, the sealing cap according to FIG. 2 has a top wall 1 and a cylindrical, circumferential wall 2. On circumferential wall 2, several retaining beads 3 are formed on the inside surface, each of which extends along a helical line of a certain length in such a way that the sealing cap can be screwed down onto the mouth of a container, which carries a multiple external thread. Here, too, however, when the sealing cap is being pulled or pried off approximately in the axial direction from the container mouth, circumferential wall 2 is able to expand elastically, so that retaining beads 3 slide over the corresponding external beads on the container mouth forming the external thread.

FIG. 3 shows half of a sealing cap and of a container mouth on an enlarged scale. The sealing cap again has a top wall 1 and a circumferential wall 2 with a retaining bead 3 formed on the inside surface. A cylindrical wall section 4 of the container mouth, onto which the sealing cap is placed, is shown; an external bead 5 is formed on this section. The sealing cap is attached to the container mouth in that the top surface or engagement surface of retaining bead 3 is effectively engaged with the bottom surface or engagement surface of external bead 5. According to the invention, the two engagement surfaces enclose a gap, which expands in the outward direction, at least as long as the positive pressure in the container is not all too great. In axial cross section, the two surfaces (more precisely: tangents to the inflection points of the intersection lines) enclose an angle $\alpha$ of approximately 5°–15°, and preferably an angle of 7°–10°.

The outward-expanding gap reduces the danger that the sealing cap will be lifted off unintentionally from the container mouth by the positive pressure prevailing in the container. In other words, a higher positive pressure can be allowed in the container.

FIGS. 4*a* and 4*b* show the action of a positive pressure in the container. This pressure exerts a force P on top wall 1 and tries to push it up. Wall 1 thus pulls circumferential wall 2 up along with it; as this happens, retaining bead 2 starts to deform elastically and is bent downward. The gap with angle $\alpha$ thus closes, as shown in FIG. 4*a*. The surfaces of external bead 5 and retaining bead 3 therefore remain in contact with each other over a wide range of intended internal pressures. Accordingly, retaining force F is also transmitted from surface to surface over the entire length of retaining bead 3 to external bead 5 of the container. As a result, retaining force F between retaining bead 3 and external bead 5 is divided into a relatively large, vertically oriented component A and a much smaller, radially outward-directed component R. The outward-directed component R is undesirable, because it has the effect of expanding circumferential wall 2 of the sealing cap. The elastic deformation of retaining bead 3 cannot be avoided, because otherwise the sealing cap could not be snapped onto the mouth of the container; the gap with angle $\alpha$ (FIG. 3), however, makes it possible for retaining bead 3, after it has been sealed and after the expected positive pressure has built up (e.g., in the case of carbonated beverages), to be bent downward, as a result of which the gap closes and retaining bead 3 arrives in its nominal position.

FIG. 4*b* shows that, as the internal pressure continues to increase, retaining force F also increases. The radially outward-directed component R thus increases also to such an extent that it is able to expand the circumferential wall of sealing cap 2. But even in the case of a positive pressure of this strength, the cap is still not blown off wall section 4 of the container, as illustrated schematically in FIG. 4*b*.

In comparison, FIG. 5 shows the action of a positive pressure in the container on a sealing cap not according to the invention. Here, in the unloaded state (drawn in solid line), there is no outward-expanding gap between the top surface of retaining bead W and the bottom surface of external bead 5. Top wall 1 again pulls circumferential wall 2 slightly upward, and thus the top surface of retaining bead W slides up and out at an angle along the bottom surface of external bead 5. Because of the absence of the outward-expanding gap, the contact point between the two beads is farther toward the outside than it is in the sealing arrangement according to the invention as shown in FIG. 4; and the radially outward directed component R', i.e., the component which acts to expand circumferential wall 2, of retaining force F' exerted by external bead 5 on retaining bead W is several times larger than radial component R of the sealing cap according to FIGS. 3 and 4, even though component A directed parallel to the container axis is the same in both cases.

As a result of the outwardly expanding gap provided in the sealing cap design according to the invention, the degree to which the force acting to expand circumferential wall 2 under increasing positive pressure in the container is reduced.

We claim:

1. A container having a snap-on seal comprising:

a container having a mouth that has at least one external bead having an engagement surface; and a sealing cap, said sealing cap comprising:

an elastically expandable cylindrical wall; and at least one elastically deformable retaining bead on the cylindrical wall and having an engagement surface for engagement with said engagement surface of said external bead, such that, when said cap is sealed on the container, the engagement surface of the retaining bead and the engagement surface of the external bead engage to form a radially outward-expanding gap having an angle that decreases in size under the action of positive pressure in the container.

2. Snap-on seal according to claim 1, such that in axial cross section, the two engagement surfaces enclose an angle of 5°–15°.

3. Snap-on seal according to claim 1, such that in axial cross section, the two engagement surfaces enclose an angle of 7°–10°.

4. Snap-on seal according to one of claims 2, 3 and 1, such that the sealing cap is a cap with multiple threads which can be snapped onto the container mouth.

* * * * *